US007628401B2

(12) United States Patent
Tu

(10) Patent No.: US 7,628,401 B2
(45) Date of Patent: Dec. 8, 2009

(54) EJECTING ROLLER ASSEMBLY FOR USE IN AUTOMATIC DOCUMENT FEEDER

(75) Inventor: Tung-Wen Tu, Taipei (TW)

(73) Assignee: Primax Electronics Ltd, Taipei (TW)

( * ) Notice: Subject to any disclaimer, the term of this patent is extended or adjusted under 35 U.S.C. 154(b) by 251 days.

(21) Appl. No.: 11/754,149

(22) Filed: May 25, 2007

(65) Prior Publication Data

US 2008/0197143 A1 Aug. 21, 2008

(30) Foreign Application Priority Data

Feb. 16, 2007 (TW) ..... 96106010 A

(51) Int. Cl.
*B65H 5/02* (2006.01)
*B65H 29/20* (2006.01)

(52) U.S. Cl. ..... 271/274; 271/314

(58) Field of Classification Search ..... 271/272, 271/273, 274, 314, 902, 225, 184
See application file for complete search history.

(56) References Cited

U.S. PATENT DOCUMENTS 4,997,179 A * 3/1991 Mizutani et al. ..... 271/306
5,988,635 A * 11/1999 Ohshima ..... 271/274
2004/0245715 A1* 12/2004 Zheng ..... 271/274
2007/0228647 A1* 10/2007 Hara ..... 271/272

* cited by examiner

*Primary Examiner*—David H Bollinger
(74) *Attorney, Agent, or Firm*—Apex Juris, pllc; Tracy M Heims

(57) ABSTRACT

The present invention relates to an ejecting roller assembly for use in an automatic document feeder to adaptively adjust the nip force between the follower roller and the driving roller in response to input and output of the paper sheet, there effectively preventing the paper sheet from getting jammed. The ejecting roller assembly includes a swing lever, a follower roller, a friction-generating element and a driving roller. The swing lever is coupled to the follower roller for adaptively adjusting the nip force. The friction-generating element is arranged between the swing lever and the follower roller for facilitating increasing the friction force between the swing lever and the follower roller. The driving roller is used for controlling input and output of the paper sheet.

10 Claims, 8 Drawing Sheets

EJECTING ROLLER ASSEMBLY FOR USE IN AUTOMATIC DOCUMENT FEEDER

FIELD OF THE INVENTION

The present invention relates to an ejecting roller assembly, and more particularly to an ejecting roller assembly for use in an automatic document feeder.

BACKGROUND OF THE INVENTION

Image scanning apparatuses such as image scanners, copiers, printers and multi function peripherals (MFPs) are widely used in our daily lives or offices for scanning images of objects such as paper sheets. As known, the image scanning apparatus usually has an automatic document feeder for automatically and continuously feeding many paper sheets one by one. During operation of the automatic document feeder, the paper sheet is readily jammed, especially in the vicinity of the ejecting roller assembly.

Referring to FIG. 1, a schematic cross-sectional view of a conventional automatic document feeder is illustrated. The automatic document feeder 200 principally includes a paper input tray 202, a paper ejecting tray 204, a pick-up roller assembly 210, a transfer roller assembly 220, an inner roller assembly 230, an ejecting roller assembly 240, a first transfer path 250 and a second transfer path 260. The ejecting roller assembly 240 includes a driving roller 241 and a follower roller 242. The driving roller 241 and the follower roller 242 are fixed within the automatic document feeder 200 and in contact with each other to provide a specified nip force therebetween.

FIG. 2A is a schematic cross-sectional view illustrating that the paper sheet is transported out of the automatic document feeder. FIG. 2B is a schematic cross-sectional view illustrating that the paper sheet is transported into the automatic document feeder.

Hereinafter, the procedure of performing a single-side scanning operation by the automatic document feeder 200 will be illustrated with reference to FIG. 2A. First of all, the paper sheet 206 to be scanned is placed in the sheet input tray 202. The pick-up roller assembly 210 transports the paper sheet 206 into the first transfer path 250 (as indicated in FIG. 1). The paper sheet 206 is successively transported by the transfer roller assembly 220, the inner roller assembly 230 and the ejecting roller assembly 240. When the paper sheet 206 is transported across a scan region (not shown) in the first transfer path 250, a first side of the paper sheet 206 is scanned by a scanning module (not shown) under the scan region. Next, the driving roller 241 of the ejecting roller assembly 240 is rotated in an anti-clockwise direction to have the paper sheet 206 eject to the paper ejecting tray 204.

Hereinafter, the procedure of performing a duplex scanning operation by the automatic document feeder 200 will be illustrated with reference to FIG. 2B. After the first side of the paper sheet 206 is scanned by using the above produce and a majority of the paper sheet 206 is ejected to the paper ejecting tray 204, the driving roller 241 of the ejecting roller assembly 240 is reversely rotated in the clockwise direction, so that the paper sheet is transported into the second transfer path 260 (as indicated in FIG. 1). Next, the paper sheet 206 is successively transported by the transfer roller assembly 220, the inner roller assembly 230 and the ejecting roller assembly 240. When the paper sheet 206 is transported across the scan region, a second side of the paper sheet 206 is scanned by the scanning module. Next, the driving roller 241 of the ejecting roller assembly 240 is rotated in the anti-clockwise direction to have the paper sheet 206 eject to the paper ejecting tray 204.

Generally, the driving roller 241 and the follower roller 242 need to be in contact with each other so as to provide sufficient nip force for transmitting the paper sheet 206 into or out from the inner portion of the automatic document feeder 200. In a case that the nip force is too large, the paper sheet fails to be smoothly transferred across the region between the driving roller 241 and the follower roller 242, and thus the paper sheet is readily jammed. For preventing the paper sheet 206 from getting jammed between the driving roller 241 and the follower roller 242, the driving roller 241 and the follower roller 242 needs to be in loose contact with each other. Under this circumstance, the nip force may be insufficient for transmitting the paper sheet 206 into or out from the inner portion of the automatic document feeder 200. Moreover, since the driving roller 241 and the follower roller 242 of the ejecting roller assembly 240 are fixed within the automatic document feeder 200, it is difficult to adjust the nip force as required.

Therefore, there is a need of providing an ejecting roller assembly for used in an automatic document feeder to effectively prevent the paper sheet from getting jammed.

SUMMARY OF THE INVENTION

It is an object of the present invention to provide an ejecting roller assembly for use in an automatic document feeder to adaptively adjust the nip force between the follower roller and the driving roller in response to input and output of the paper sheet, there effectively preventing the paper sheet from getting jammed.

In accordance with an aspect of the present invention, there is provided an ejecting roller assembly for use in an automatic document feeder to transport a paper sheet. The ejecting roller assembly includes a swing lever, a follower roller, a friction-generating element and a driving roller. The swing lever has a first end coupled to the automatic document feeder such that the swing lever is pivotal about the first end. The follower roller is coupled to a second end of the swing lever. The friction-generating element is arranged between the swing lever and the follower roller for facilitating increasing the friction force between the swing lever and the follower roller. The driving roller is coupled to the automatic document feeder. When the paper sheet is transported therebetween in an inward direction, the follower roller has a tendency to be close to the driving roller, such that the nip force between the follower roller and the driving roller is increased. When the paper sheet is transported therebetween in an outward direction, the follower roller has a tendency to be away from the driving roller, such that the nip force between the follower roller and the driving roller is reduced.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
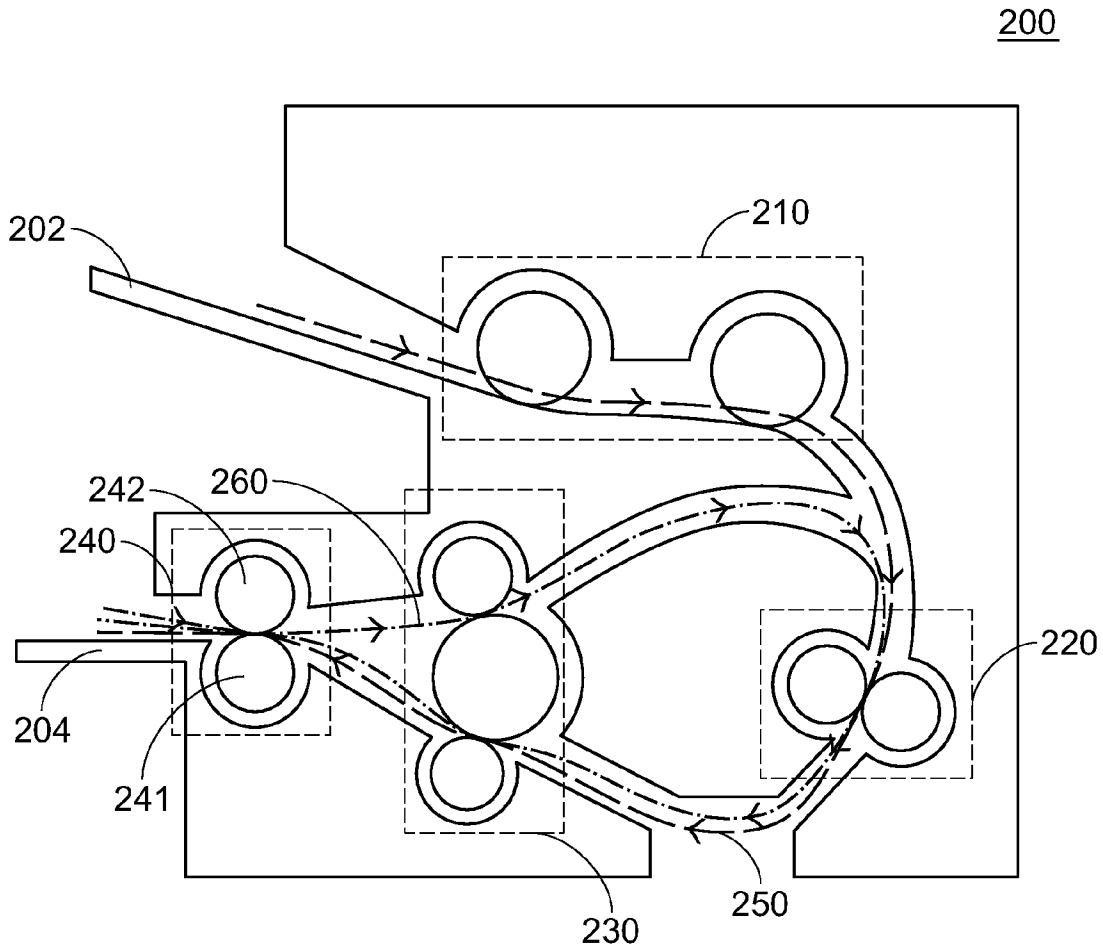
FIG.1 PRIOR ART
FIG. 1 is a schematic cross-sectional view of a conventional automatic document feeder.
Figure 2A:
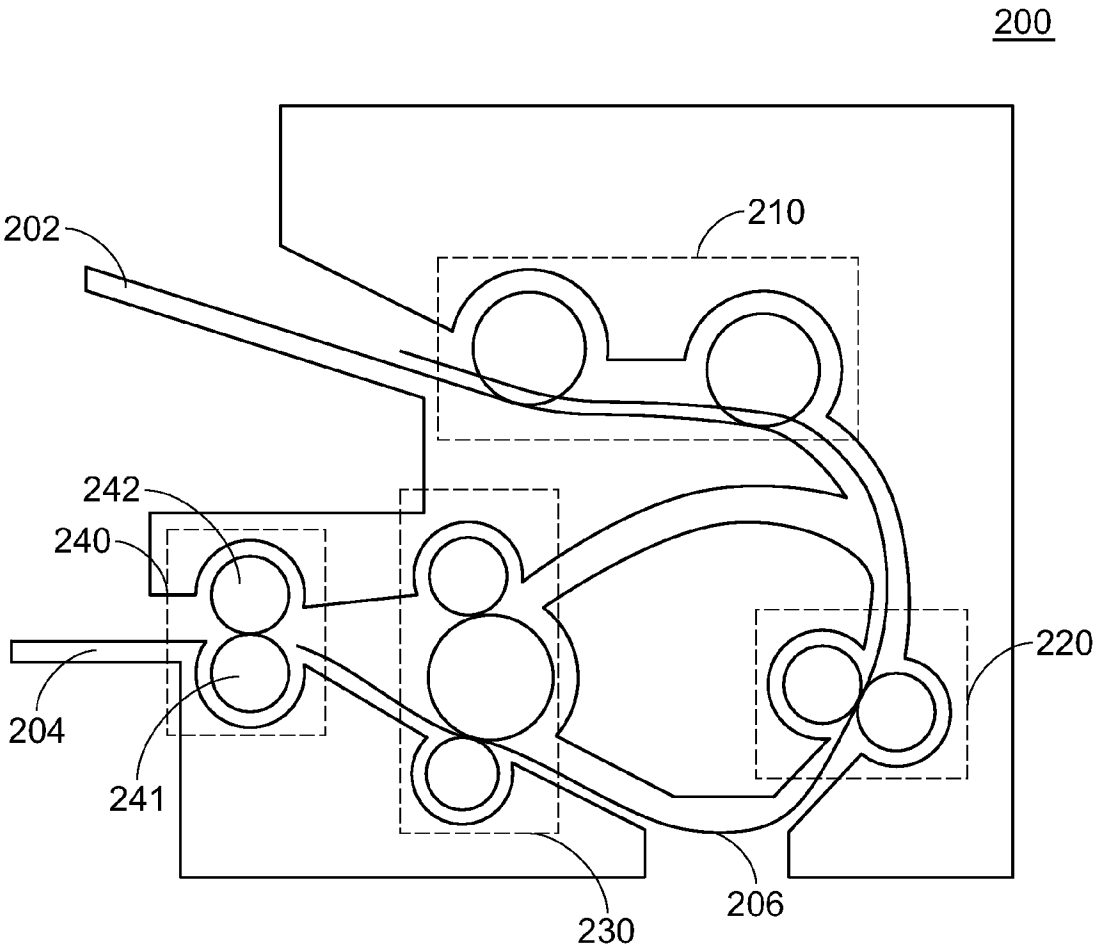
FIG.2A PRIOR ART
FIG. 2A is a schematic cross-sectional view illustrating that the paper sheet is transported out of the automatic document feeder.
Figure 2B:
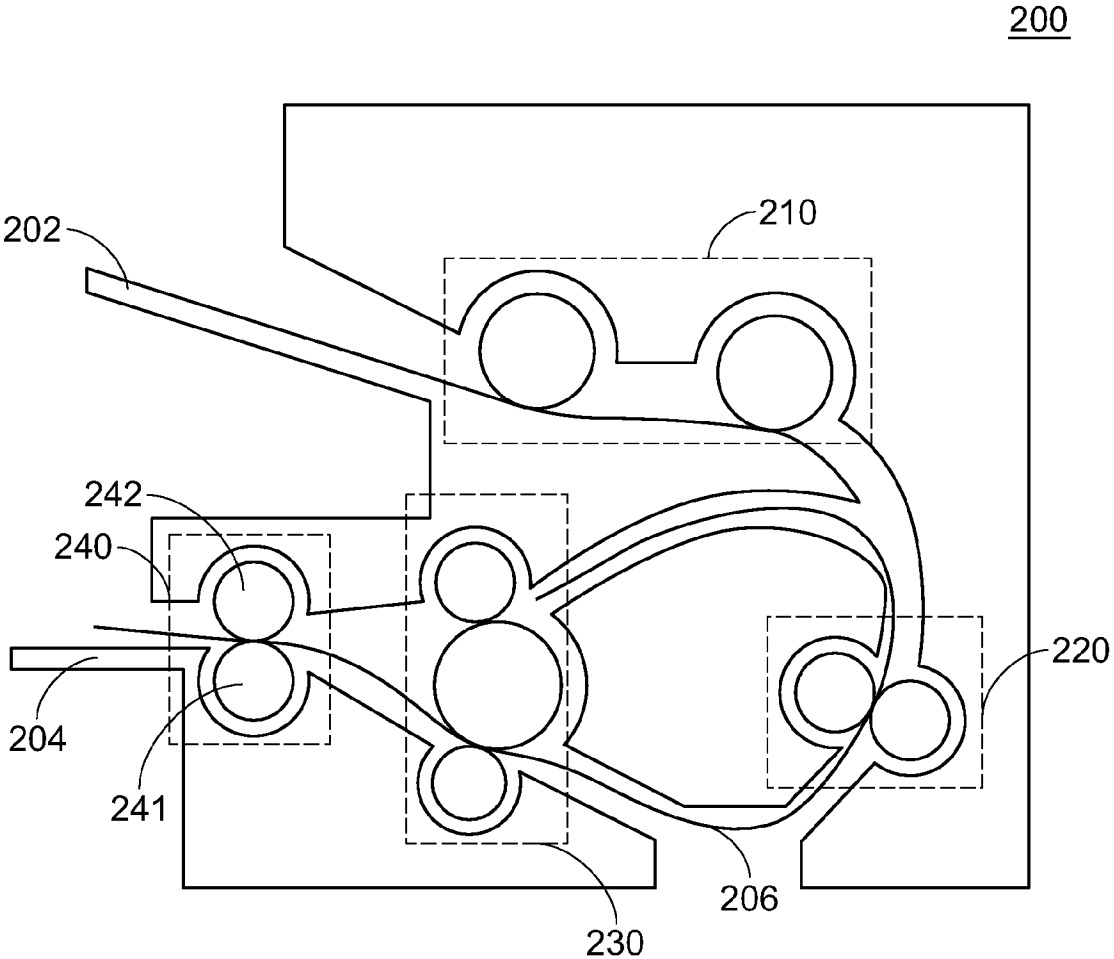
FIG.2B PRIOR ART
FIG. 2B is a schematic cross-sectional view illustrating that the paper sheet is transported into the automatic document feeder.
Figure 3:
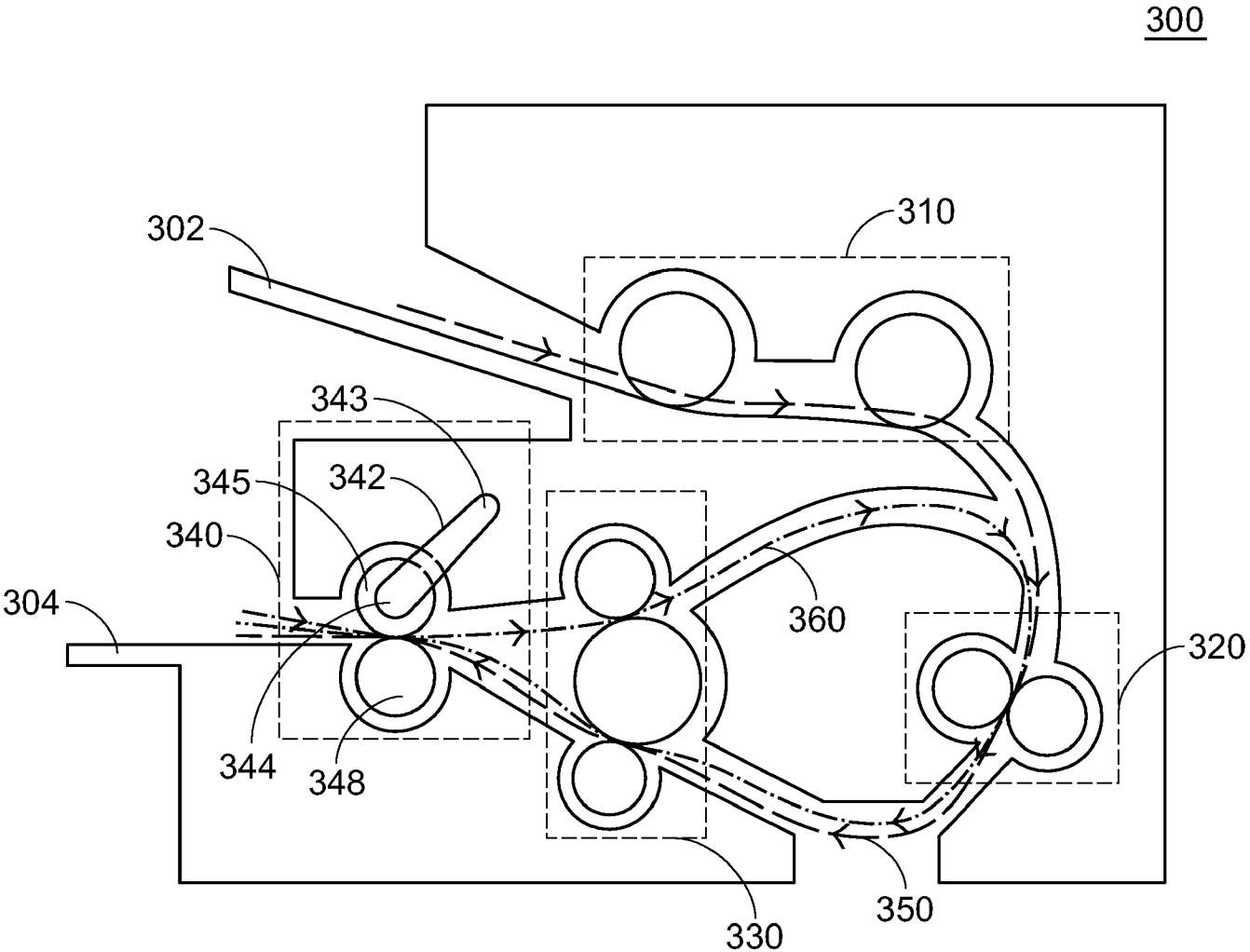
FIG. 3 is a schematic cross-sectional view of an automatic document feeder according to a preferred embodiment of the present invention.

Referring to FIG. 3, a schematic cross-sectional view of an automatic document feeder according to a preferred embodiment of the present invention is illustrated. The automatic document feeder 300 principally includes a paper input tray 302, a paper ejecting tray 304, a pick-up roller assembly 310, a transfer roller assembly 320, an inner roller assembly 330, an ejecting roller assembly 340, a first transfer path 350 and a second transfer path 360. The ejecting roller assembly 340 includes a swing lever 342, a follower roller 345, a friction-generating element (not shown) and a driving roller 348. The swing lever 342 includes a first end 343 fixed to the automatic document feeder 300 and a second end 344 coupled to the follower roller 345.

Hereinafter, a process of adaptively adjusting the nip force between the follower roller 345 and the driving roller 348 in response to input and output of the paper sheet will be illustrated as follows with reference to FIG. 4A and 4B. The arrangement of the ejecting roller assembly 340 will be illustrated later.

Figure 4A:
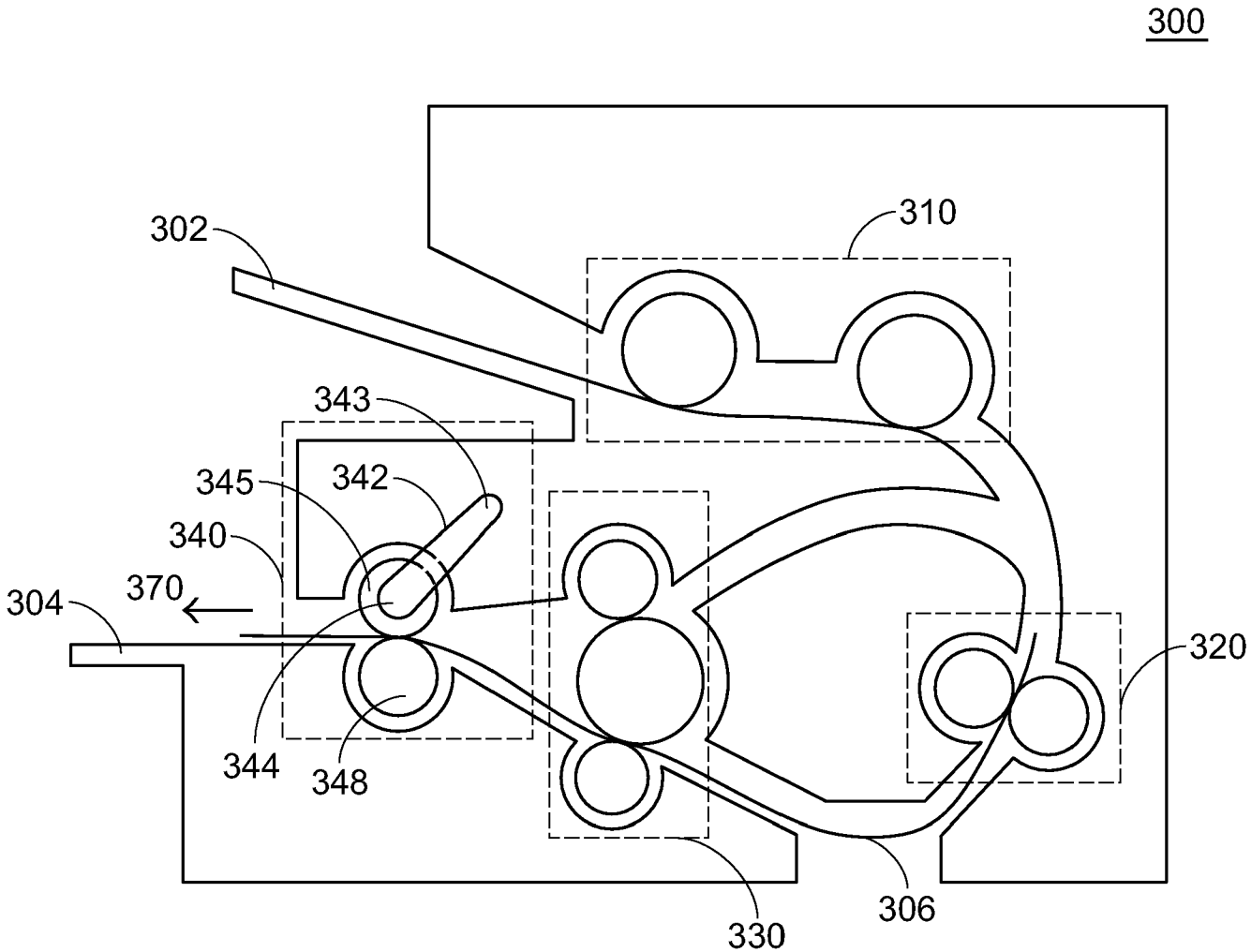
FIG. 4A is a schematic cross-sectional view illustrating that the paper sheet is transported across the ejecting roller assembly in the outward direction.

FIG. 4A is a schematic cross-sectional view illustrating that the paper sheet is transported across the ejecting roller assembly 340 in the outward direction. First of all, the paper sheet 306 to be scanned is placed in the sheet input tray 302. The pick-up roller assembly 310 transports the paper sheet 306 into the first transfer path 350 (as indicated in FIG. 3). The paper sheet 306 is successively transported by the transfer roller assembly 320, the inner roller assembly 330 and the ejecting roller assembly 340. When the paper sheet 306 is transported across a scan region (not shown) in the first transfer path 350, a first side of the paper sheet 306 is scanned by a scanning module (not shown) under the scan region. Next, the driving roller 348 of the ejecting roller assembly 340 is rotated in the anti-clockwise direction to eject the paper sheet 306 in the outward direction 370. Since the rotating shaft (not shown) of the driving roller 348 is fixed within the automatic document feeder 300, the driving roller 348 is rotated with respect to the rotating shaft thereof when the paper sheet is transported across the ejecting roller assembly 340 in the outward direction 370. Whereas, during the paper sheet 306 is transported across the ejecting roller assembly 340 in the outward direction 370, the follower roller 345 has a tendency to be away from the driving roller 348 in the outward direction 370. Since the displacement of the follower roller 345 is restrained by the swing lever 342, an upward component of force is applied on the follower roller 345. The upward component of force may reduce the nip force between the follower roller 345 and the driving roller 348. Accordingly, the probability of causing jammed paper sheet is minimized.

Figure 4B:
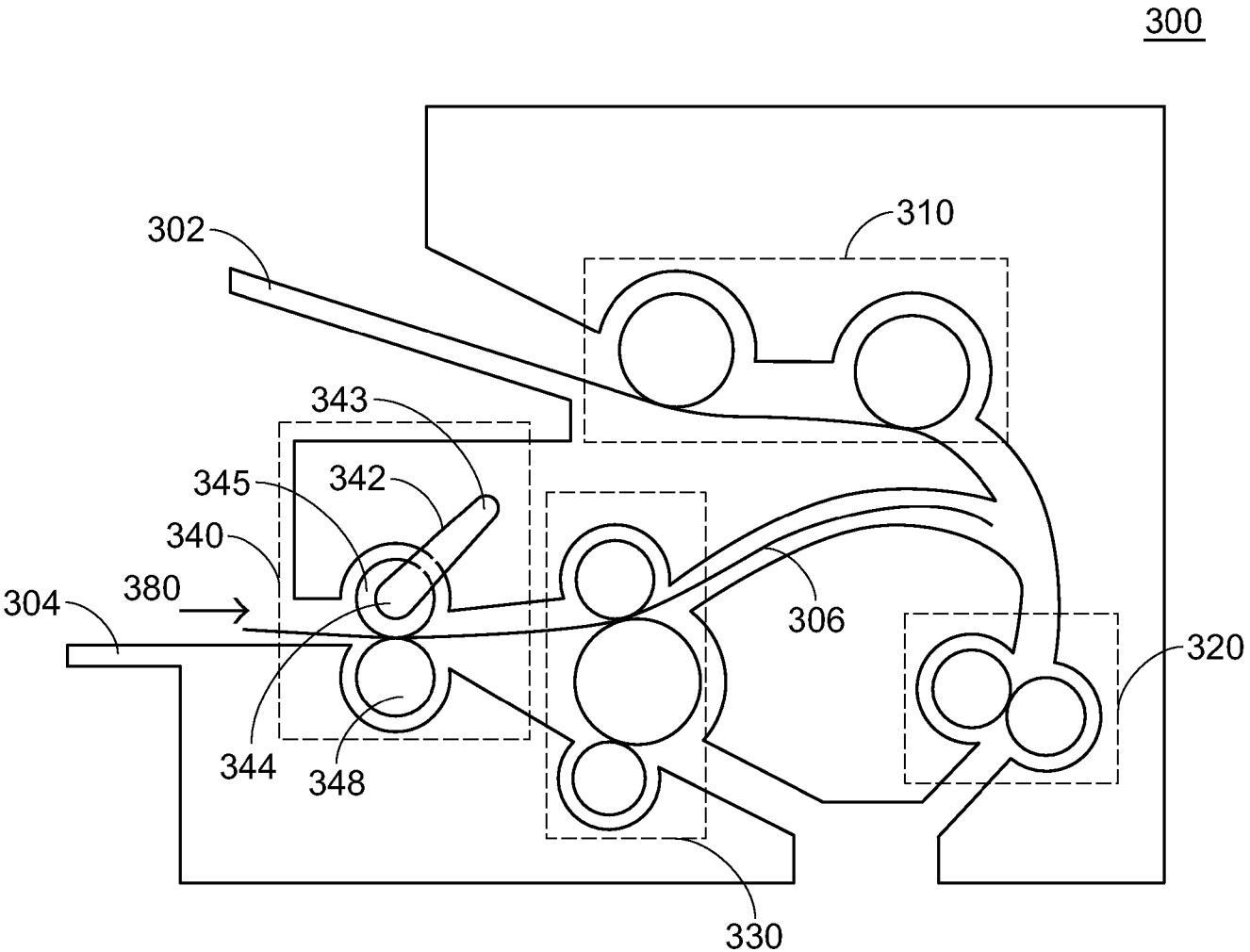
FIG. 4B is a schematic cross-sectional view illustrating that the paper sheet is transported across the ejecting roller assembly in the inward direction.

FIG. 4B is a schematic cross-sectional view illustrating that the paper sheet is transported across the ejecting roller assembly 340 in the inward direction. After the first side of the paper sheet 306 is scanned by using the above produce and a majority of the paper sheet 306 is ejected to the paper ejecting tray 304, the driving roller 348 of the ejecting roller assembly 340 is reversely rotated in the clockwise direction, so that the paper sheet is transported into the second transfer path 360 (as indicated in FIG. 3) in the inward direction 380. Likewise, the driving roller 348 is rotated with respect to the rotating shaft thereof when the paper sheet is transported across the ejecting roller assembly 340 in the inward direction 380. Whereas, during the paper sheet 306 is transported across the ejecting roller assembly 340 in the inward direction 380, the follower roller 345 has a tendency to be close to the driving roller 348 in the inward direction 380. Since the displacement of the follower roller 345 is restrained by the swing lever 342, a downward component of force is applied on the follower roller 345. The downward component of force may increase the nip force between the follower roller 345 and the driving roller 348. Accordingly, the paper sheet may be smoothly transported into the second transfer path 360 of the automatic document feeder 300.

Please refer to FIG. 4A and FIG. 4B. The first end 343 of the swing lever 342 is coupled to a first position of the automatic document feeder 300, which is disposed above the driving roller 348 and slants toward the internal side of the automatic document feeder 300. During the paper sheet 306 is transported across the ejecting roller assembly 340 in the outward direction 370, an upward component of force is applied on the follower roller 345 and thus the probability of causing jammed paper sheet is minimized. Whereas, during the paper sheet 306 is transported across the ejecting roller assembly 340 in the inward direction 380, a downward component of force is applied on the follower roller 345 and thus the paper sheet will be smoothly transported into the second transfer path 360 of the automatic document feeder 300.

Figure 5:
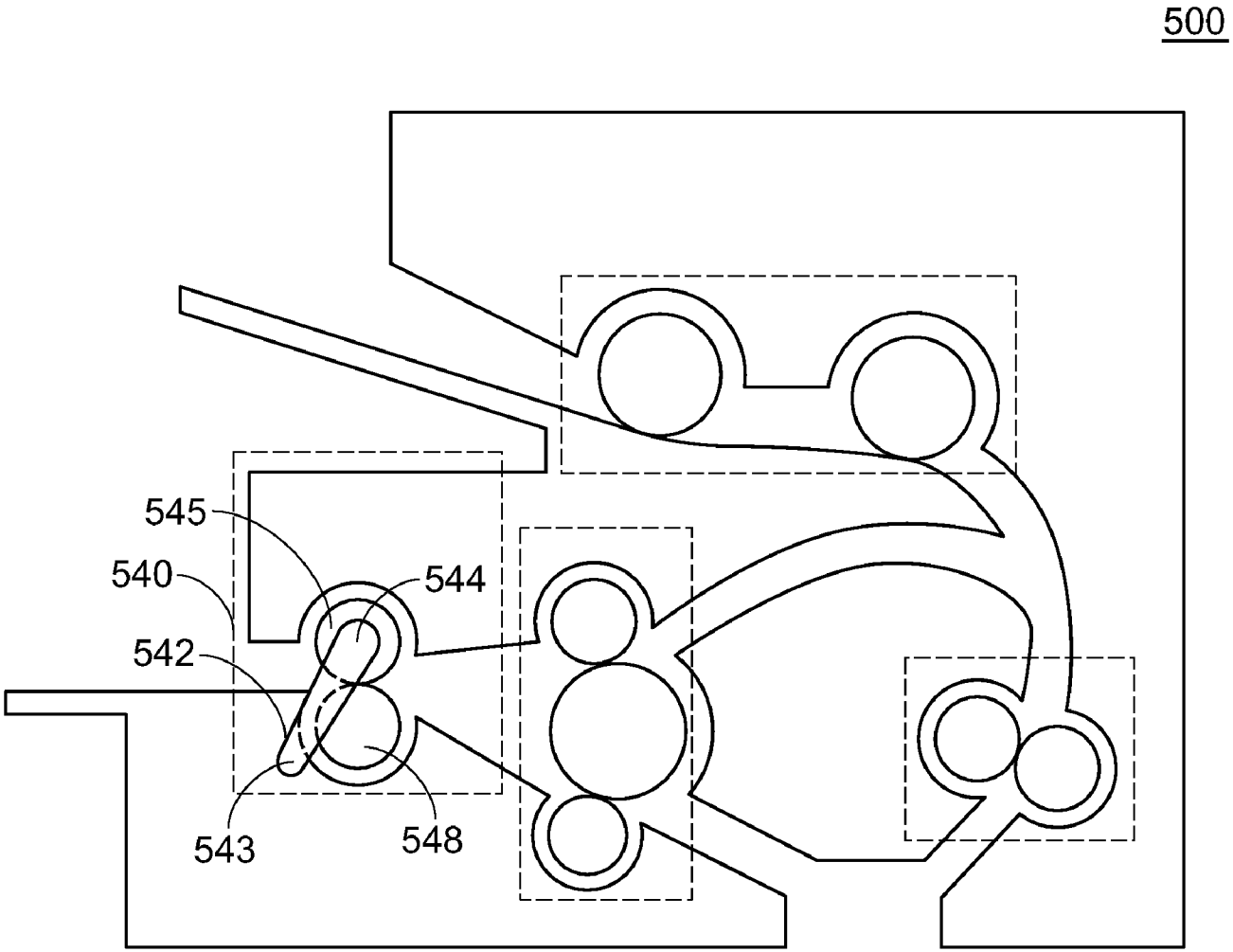
FIG. 5 is a schematic cross-sectional view of an automatic document feeder according to another preferred embodiment of the present invention.

Referring to FIG. 5, a schematic cross-sectional view of an automatic document feeder according to another preferred embodiment of the present invention is illustrated. The automatic document feeder 500 of this embodiment is similar to that of the first preferred embodiment except for the arrangement of the swing lever. In this embodiment, the swing lever 542 includes a first end 543 fixed to the automatic document feeder 500 and a second end 544 coupled to the follower roller 545. The first end 543 of the swing lever 542 is coupled to a second position of the automatic document feeder 500, which is disposed under the driving roller 548 and slants toward the external side of the automatic document feeder 500. Likewise, during the paper sheet is transported across the ejecting roller assembly 540 in the outward direction, a downward component of force is applied on the follower roller 545 and thus the probability of causing jammed paper sheet is minimized. Whereas, during the paper sheet is transported across the ejecting roller assembly 540 in the inward direction, an upward component of force is applied on the follower roller 545 and thus the paper sheet will be smoothly transported into the second transfer path of the automatic document feeder 500.

Figure 6:
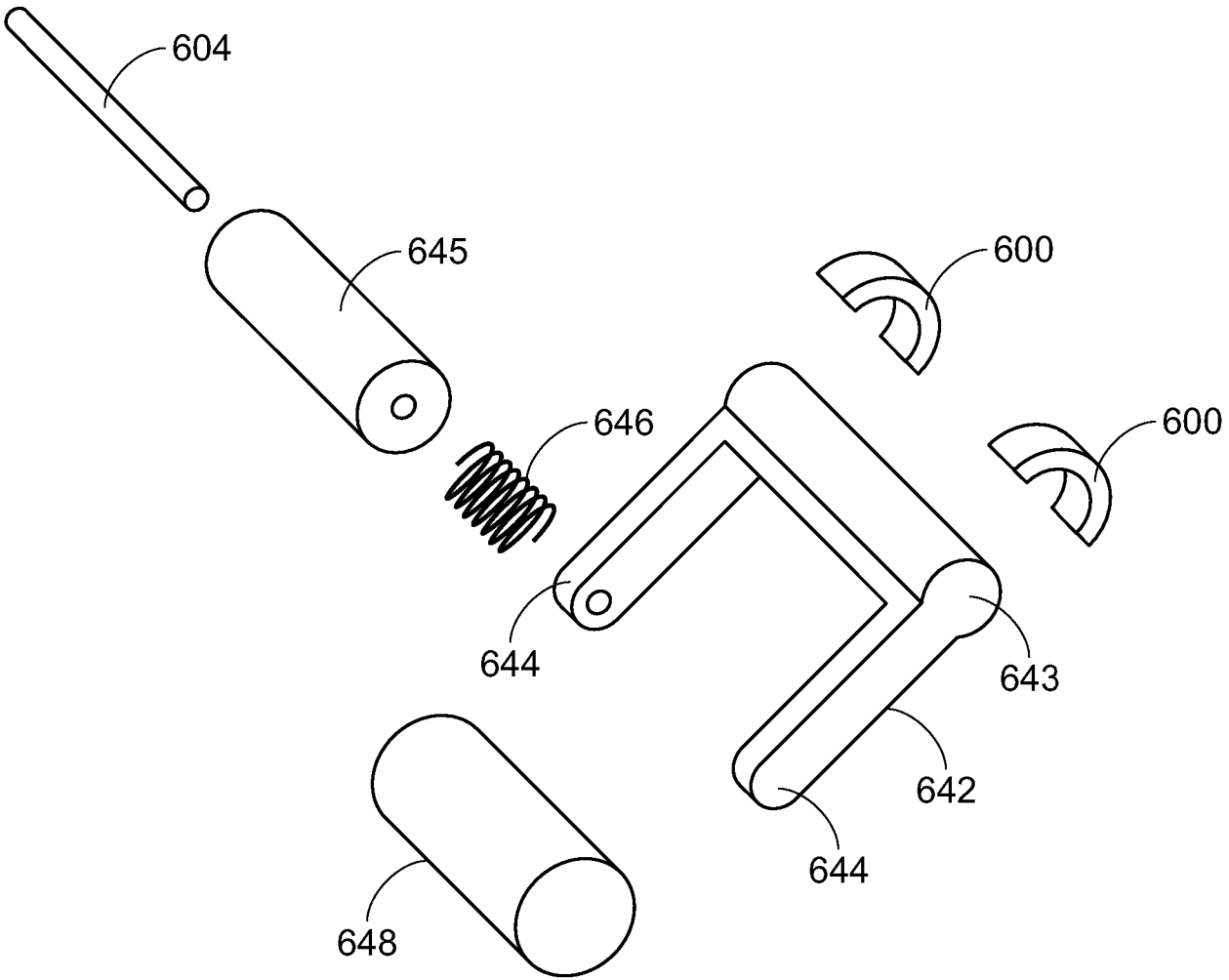
FIG. 6 is a schematic exploded view of an ejecting roller assembly according to the present invention.

Referring to FIG. 6, a schematic exploded view of an ejecting roller assembly according to the present invention is illustrated. The ejecting roller assembly principally comprises a hinge stand 600, a swing lever 642, a resilient element 646, a follower roller 645, a rotating shaft 604 and a driving roller 648. The first end 643 of the swing lever 642 is a hinge coupled to the hinge stand 600 such that the swing lever 642 is pivotal about the first end 643. The resilient element 646 is a spiral spring. The spiral spring 646 and the follower roller 645 are sheathed around the rotating shaft 604. Both terminals of the rotating shaft 640 are fixed onto the second end 644 of the swing lever 642. Both terminals of the spiral spring 646 are sustained between the second end 644 of the swing lever 642 and a sidewall of the follower roller 645. The resilient element 646 may increase the frictional force between the follower roller 645 and the swing lever 642. Since the frictional force between the follower roller 645 and the swing lever 642 is increased, the effectiveness of obtaining upward or downward component force is enhanced when the paper sheet is transported across the ejecting roller assembly. Accordingly, the nip force between the follower roller 645 and the driving roller 648 is adaptively adjusted.

It is noted that, however, those skilled in the art will readily observe that numerous modifications and alterations of the ejecting roller assembly may be made while retaining the teachings of the invention. For example, the hinge stand may be replaced by two retaining recess structures and the first end of the swing lever may have a channel therein. After a retaining rod is penetrated through the channel and the both terminals thereof are embedded into the retaining recess structures, the swing lever is pivotal about the first end. Moreover, the resilient element may be made of other elastic material such as a resilient sheet, rubber or foam. For example, in a case that the resilient element is a foam-made sleeve, the foam-made sleeve is sheathed around the rotating shaft and also sustained between the second end of the swing lever and a sidewall of the follower roller. In another case that the resilient element is a resilient sheet having a body portion and an arm portion, the body portion is coupled to the first end of the swing lever and the arm portion is coupled to the follower roller. In a further case that the resilient element is a rubbery sheet, the surface of the rotating shaft is covered with the rubbery sheet and the rubbery sheet is arranged between the rotating shaft and the follower roller, thereby increasing the friction between the rotating shaft and the follower roller.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An ejecting roller assembly for use in an automatic document feeder to transport a paper sheet, said ejecting roller assembly comprising:

a swing lever having a first end coupled to said automatic document feeder such that said swing lever is pivotal about said first end;

a follower roller coupled to a second end of said swing lever;

a resilient element arranged between said swing lever and said follower roller for facilitating increasing the friction force between said swing lever and said follower roller; and a driving roller coupled to said automatic document feeder, wherein said follower roller applies a downward component of force to said driving roller when said paper sheet is transported therebetween in an inward direction due to a downward rotational response of said swing lever, such that the nip force between said follower roller and said driving roller is increased, and said follower roller applies less force to said driving roller when said paper sheet is transported therebetween in an outward direction due to a upward rotational response of said swing lever, such that the nip force between said follower roller and said driving roller is reduced.

2. The ejecting roller assembly according to claim 1 further includes a rotating shaft fixed onto said second end of said swing lever, and said follower roller is sheathed around said rotating shaft.

3. The ejecting roller assembly according to claim 2 wherein said resilient element is a spring.

4. The ejecting roller assembly according to claim 3 wherein said spring is a spiral spring sheathed around said rotating shaft, and both terminals of said spiral spring are sustained between said second end of said swing lever and a sidewall of said follower roller.

5. The ejecting roller assembly according to claim 1 wherein said first end of said swing lever is coupled to a first position of said automatic document feeder, which is disposed above said driving roller and slants toward an internal side of said automatic document feeder.

6. The ejecting roller assembly according to claim 1 wherein said first end of said swing lever is coupled to a second position of said automatic document feeder, which is disposed under said driving roller and slants toward an external side of said automatic document feeder.

7. The ejecting roller assembly according to claim 1 wherein said automatic document feeder further includes a hinge stand, and said first end of said swing lever includes a hinge coupled to said hinge stand.

8. The ejecting roller assembly according to claim 2 wherein said resilient element is a resilient sheet.

9. The ejecting roller assembly according to claim 2 wherein said resilient element is rubber.

10. The ejecting roller assembly according to claim 2 wherein said resilient element is foam.

* * * * *